United States Patent [19]

Glass

[11] 4,416,582

[45] Nov. 22, 1983

[54] MULTI-STAGE TURBINE ROTOR

[76] Inventor: Benjamin G. Glass, 3011 Stockett Way, San Diego, Calif. 92117

[21] Appl. No.: 188,987

[22] Filed: Sep. 22, 1980

[51] Int. Cl.[3] ..... F01D 1/36; F01D 17/14

[52] U.S. Cl. ..... 415/59; 415/90; 415/110; 415/121 A; 415/123; 415/165; 415/168; 415/198.1

[58] Field of Search ..... 415/52, 59, 90, 110, 415/113, 123, 165, 121 A, 121 R, 168, 53 R, 56, 76, DIG. 4, 198.1, 199.1

[56] References Cited

U.S. PATENT DOCUMENTS

| | | | |
|---|---|---|---|
| 3,066,912 | 12/1962 | Scheper | 415/121 A |
| 3,313,518 | 4/1967 | Nancarrow | 415/202 UX |
| 4,025,225 | 5/1977 | Durant | 415/90 |
| 4,036,561 | 7/1977 | Harand et al. | 415/123 X |
| 4,036,584 | 7/1977 | Glass | 415/90 |
| 4,232,992 | 11/1980 | Possell | 415/90 |

FOREIGN PATENT DOCUMENTS

| | | | |
|---|---|---|---|
| 25109 | of 1908 | United Kingdom | 415/198.1 |

*Primary Examiner*—Stephen Marcus

*Assistant Examiner*—Joseph M. Pitko

*Attorney, Agent, or Firm*—Penrose, Lucas, Albright, Mason, Mason & Albright

[57] ABSTRACT

A multi-stage turbine has an inflow disc pack that directs motivating fluid to an outflow disc pack on the same shaft. The packs are fitted to rotate between plates that web a turbine casing interior and fluid entry into the casing to the inflow pack is via nozzles in a ring assembly fixed to the casing. Each disc pack is made up by spaced apart discs with fences that guide the motivating fluid first through the inflow pack and then the outflow pack. A central passageway in the packs and adjacent the shaft communicates fluid inflow to outflow. Fluid exhaust is through exits at the casing bottom. In one version, the disc packs are conical and when seen from the side, the packs with webbed plates are X configured in section. In another version, the inflow pack is flat, the outflow pack conical and the casing of both versions are configured to provide low losses and maximum strength. The nozzles can be convergent-divergent in a plenum located adjacent the inflow pack circumference.

11 Claims, 8 Drawing Figures

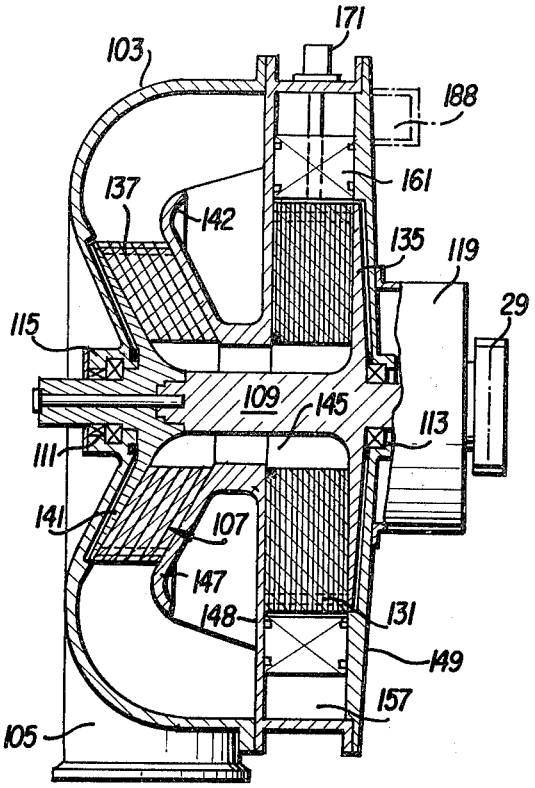
FIG. 6
FIG. 8
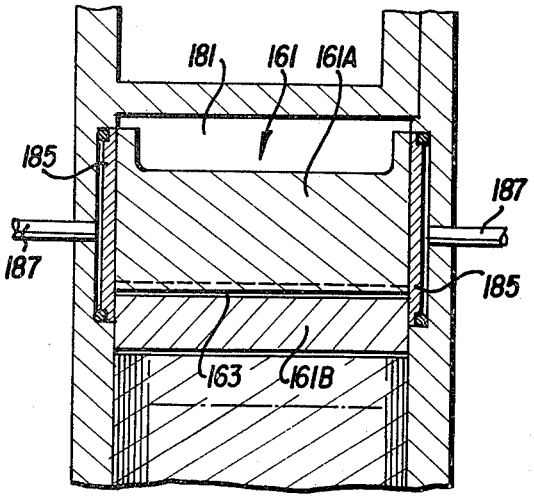
FIG. 7
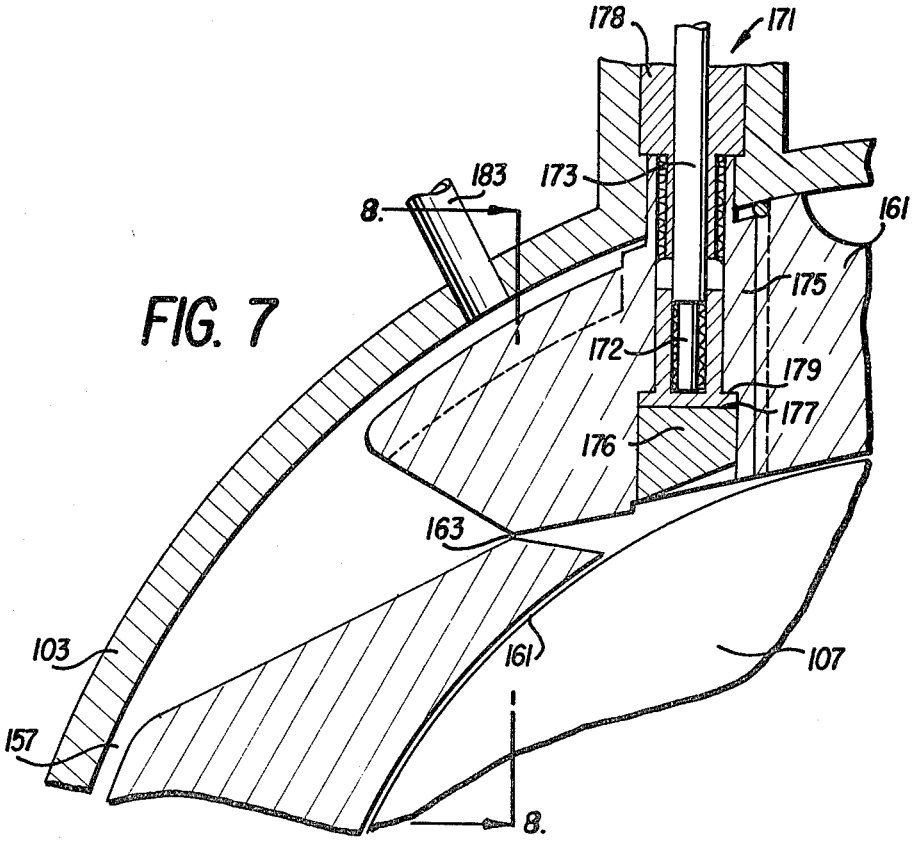

MULTI-STAGE TURBINE ROTOR

SUMMARY OF THE INVENTION

The turbine rotor of this invention utilizes sequentially a radial inflow pack similar to that disclosed in U.S. Pat. No. 4,036,584, coupled on a single shaft with a radial outflow pack. Together, the inflow-outflow packs provide a very compact, lightweight, two-stage turbine construction. Further stating for very high temperature pressure applications in dual rotor or dual rotor followed by a single rotor are obvious extensions of the principles disclosed herein. In the present invention, the turbine can be constructed to have a radial inflow/outflow arrangement with an annular single nozzle or multiple nozzles. Also, a variable nozzle construction and debris collector can be present. Utilized with upstream to turbine sensors and rapid control capability, turbine debris damage is avoided. Better energy conservation is accomplished with variable nozzles as motivating fluid consumption is automatically monitored with load variations and, in the case of wet steam sudden flashing, overspeed dangers eliminated. All above innovations are equally applicable to a single stage version turbine.

BRIEF DESCRIPTION OF THE DRAWINGS

FIG. 6 is a side view in section taken along the lines 6—6 of FIG. 5;

FIG. 7 is a fragmentary section of the nozzle with brake; and

FIG. 8 is a scrap view of a debris collector taken along the lines 8—8 of FIG. 7.

DESCRIPTION OF THE PREFERRED EMBODIMENTS

Figure 2:
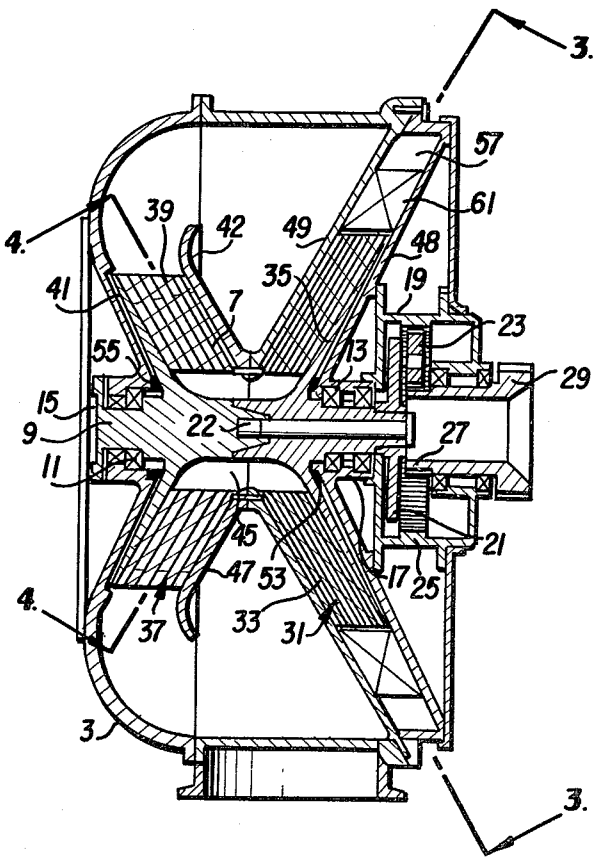
FIG. 2 is a side elevation in section taken along the lines 2—2 of FIG. 1.
Figure 4:
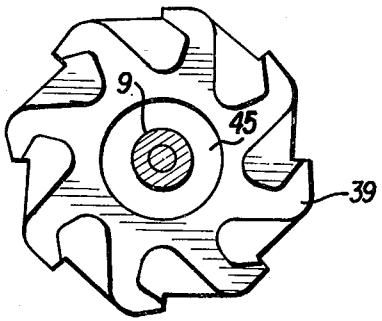
FIG. 4 is a front elevation in section taken along the lines 4—4 of FIG. 2.
Figure 1:
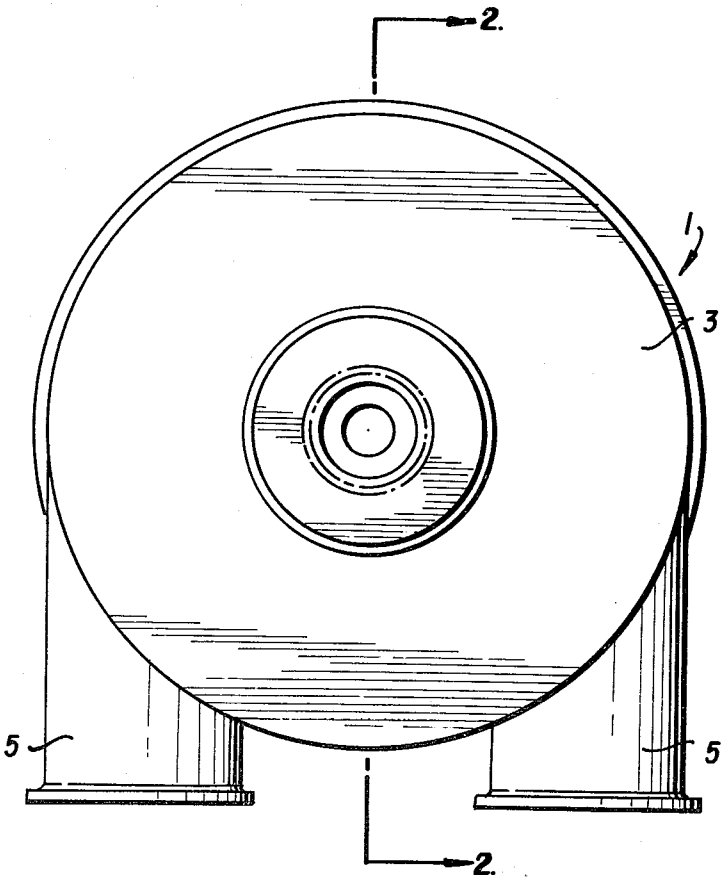
FIG. 1 is a front elevation of the turbine.

In FIG. 1, the turbine 1 has an outer casing 3 with dual exits 5 at each bottom side which also support the turbine 1. The casing 3 is configured to conform to the rotor 7 structure and can be toroidal or cylindrical in configuration for strength. As best seen in FIG. 2, the rotor 7 includes a common shaft 9 journalled on rear bearings 11 and front bearings 13 supported on casing bosses 15 and 17, respectively. Boss 17 is held by gear box housing 19 fitted in the front of casing 3. The gear arrangement can be planetary with sun wheel 21 fixed by bolt 22 on shaft 9 and planet gear 23 rotatably mounted on wheel 21 and in mesh with teeth 25 fixed to the inner circular surface of housing 19 as well as teeth 27 on output hub 29 journalled in the front of housing 19.

The rotor 7 includes a radial inflow pack 31 of discs 33 similar to discs 20 in U.S. Pat. No. 4,036,584 which are separated from one another by internal fences that can be separate spiral segments as seen in the drawings of that patent.

The discs 33 are supported on backing plate 35 integral with or attached to shaft 9 and form the first or inflow stage. Mounted in a similar manner is conical disc pack 37 which forms a radial fluid outflow and second stage of the turbine. The pack 37 is made of discs 39 which are mounted on a backing plate 41 integral with or attached to shaft 9. The discs 39, like 33, are interconnected to one another by fences that are brazed or otherwise joined to neighboring discs and the backing plates 35 and 41. The centers of discs 33 and 39 have aligned openings that form a central fluid passageway 45 at the center of rotor 7, near a reduced section of shaft 9.

The disc packs 31 and 37 are supported on shaft 9 and internal webbing plates 47, 48 and 49 are joined to one another and separated from the backing plates 35 and 41 by circular graphite seals 53 and 55 to prevent fluid leakage. Plate 47 has a flared or curved outer part 42 that forms a fluid exit guide. As seen in FIG. 2, the rotor is configured as an "X". The motivating fluid, such as steam or gas, is introduced through opposite inlets 56 into a plenum 57 formed by webbing plates 48 and 49 and the adjacent wall of casing 3. Immediately adjacent and surrounding pack 31 is a stationary ring nozzle 61.

Figure 3:
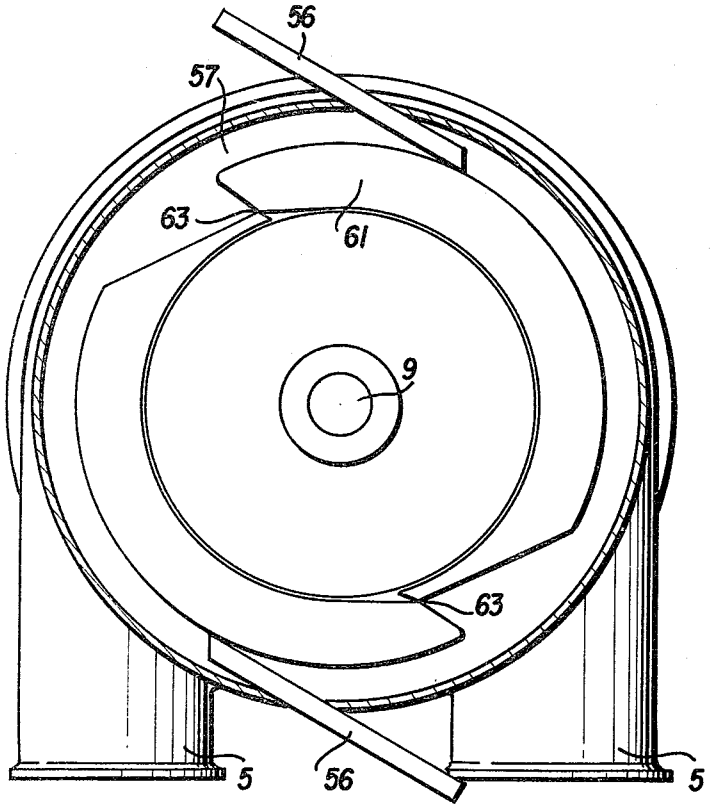
FIG. 3 is a rear sectional view of the first stage taken along the lines 3—3 of FIG. 2.

As best seen in FIG. 3, fluid enters the plenum 57 and passes through nozzle 61 to inflow pack 31 and thereafter to central passageway 45 and through outflow pack 37 and thereafter exits 5. The ring nozzle 61 preferably includes two identical segments that are fastened to the casing with diametrical throats 63 located remote from inlets 56. The nozzle 61 can be essentially the same as that seen in FIG. 8 and described below.

Figure 5:
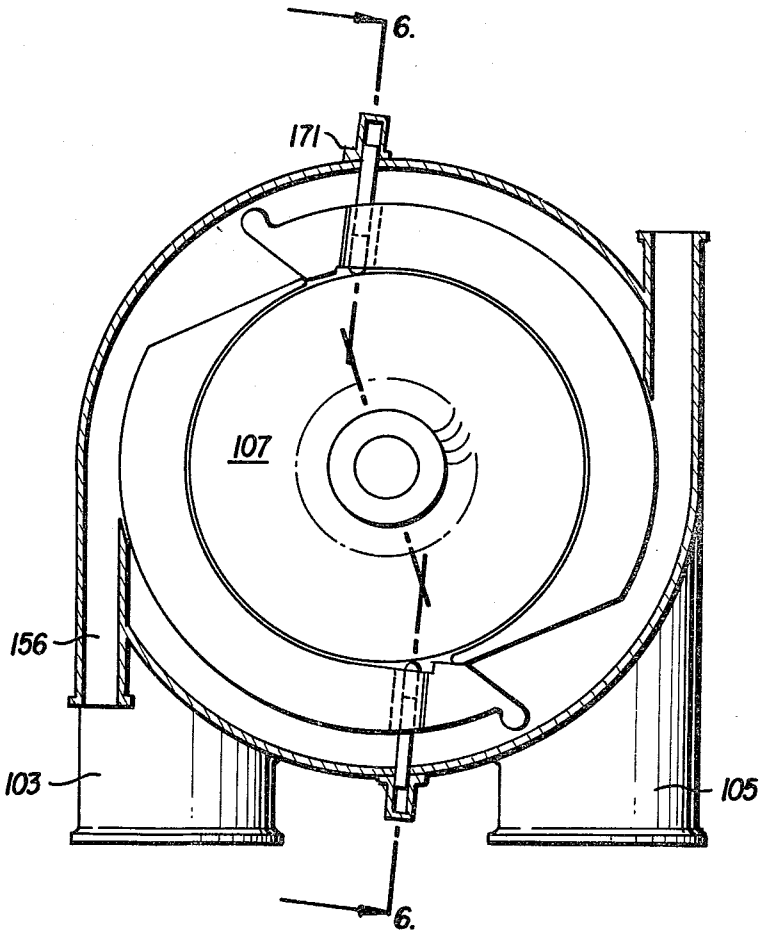
FIG. 5 is a front elevation in section of a modified turbine.

In FIGS. 5 and 6 a modified turbine has an outer casing 103 having exits 105 at each bottom support. A rotor 107 with shaft 109 is journalled in rear bearings 111 and front bearings 113 respectively. Gear box 119 houses a planetary gear system similar to that seen in FIG. 2. Shaft 109 is bolted to boss 115 which terminates external of casing 103. Rotor 107 includes a radial inflow pack 131 of substantially flat discs that are again separated by internal fences that are welded or brazed together and to backing plate 135 on shaft 109. Outflow disc pack 137 can be the same as seen in FIG. 2 with conical discs 39 attached to one another and to backing plate 141 on shaft 109 or boss 115.

The centers of packs 131 and 137 are open and aligned to form passageway 145. Diagrammatically opposed inlets 156 feed motivating fluid such as steam or gas to a plenum 157 and to nozzle ring 161 which are preferably tangential to the nozzle as in the FIG. 2 embodiment. The webbing plates 147, 148 and the backing plate 149 interconnect with and form part of casing 103 and plate 147 has a flared or curved part 142 to guide fluid.

In my copending application filed of even date and titled "Shaftless Turbine" similar nozzles are disclosed and are interchangeable. The disclosure of the copending application is incorporated herein as a related application.

As seen in FIG. 8, the throat 163 is formed between the overlapping portions of the segments of ring 161. The top of upper segment 161A has a pocket 181 that forms a debris trap and outlet pipe 183 (FIG. 7) can be added to syphon accumulations of debris. Alternatively, accumulated debris can be removed automatically from pocket 181 when signalled by a detector. In geothermal applications, automatic debris removal is advantageous to avoid shut-down.

Adjacent the throat 163 the plates 148 and 149 have been modified to have circular side seal plates 185 that can be pressured through hydraulic lines 187 and forced against nozzle segments 161A and 161B to ensure sealing. Both throats 163 are structured identically and their respective mechanisms 171 as well as hydraulic lines 187 communicate with one another for synchronization.

The sun and planet gearing in the FIG. 6 turbine can be essentially the same as that shown in FIG. 2 and the gear box 119 is configured to fit on the exterior of outer plate 149.

As seen in FIGS. 7 and 8, the throats 163 of ring 161 are convergent-divergent and are adjustable. The ring is solid and spans the width of the inlet pack 131 and plenum 157. The ring 161 comprises a combined rotor brake and throat adjustment device 171 in which tube 173 has a lower part 172 threaded to head 177 which is slideable in ring 161. The end of the part 172 can be rotated to bear on plunger head 177 that mounts graphite plug 176. The tube 173 is slideable in block 178 screwed to ring 161. Thus, sliding tube 173 down moves head 177 so that plug 176 bears on the outer circumference of pack 131 to brake same. Sliding the tube 173 upwardly can raise head 177 until it bears on shoulders 179 of ring 161 as shown in FIG. 7. Further upward movement of tube 173 will raise the upper ring segment and open or expand throat 163.

The ring segments are attached to the casing 103 a distance from throats 163 to allow adjustment of the throat from about $\frac{1}{8}''$ to $\frac{5}{8}''$ with the ring 161 being about 4" deep as seen in FIG. 7. However, throat dimensions are a function of the turbine size and can, therefore, vary widely. Also, the sliding movements of tube 173 can be automatic and effected by a conventional servo mechanism depending on, inter alia, the temperature and pressure of the motivating fluid. Also, instant or rapid deceleration of the rotor can be effected with the brake device if overspeed is detected or in the event of debris build up.

Although specific embodiments of the multi-stage turbine are disclosed herein, it is to be understood that obvious variations are intended to be included as set forth in the appended claims.

What is claimed is:

1. A multi-stage turbine for geothermal application which is driven by a fluid such as steam or a similar gas and which comprises a casing and a rotor on a shaft journalled for rotation in said casing, said rotor comprising two adjacent disc packs mounted in tandem on said shaft, the first of said packs being a circular fluid inflow pack with an outer circumference having fluid inlet means, at least one inlet for the introduction of fluid under pressure into said casing, an internal nozzle mounted in said casing for communicating and controlling the flow of fluid from said inlet to said inlet means and through said inflow pack to drive said shaft, the second of said packs comprising spaced apart conically configured discs having an outer circumference with fluid outlet means, the discs of each pack having central openings which define a common fluid passageway within said rotor and said passageway being located adjacent said shaft to provide direct communication for fluid discharged from the interior of said inflow pack to be received by the interior of said outflow pack and to flow through said outflow pack to drive said shaft before the fluid exits from said outflow means at the outer circumference of said second pack.

2. A turbine as claimed in claim 1, wherein there are two opposite inlet conduits leading into a ring nozzle that surrounds the outer circumference of said inlet pack.

3. A turbine as claimed in claim 1, wherein said packs are each held within respective web plates and said plates are fastened to one another and the casing interior.

4. A turbine as claimed in claim 1, wherein the inflow pack comprises flat discs and a debris removal opening leads into said inlet.

5. A turbine as claimed in claim 1, wherein said nozzle comprises a segmented ring in a plenum that surrounds said rotor, said nozzle being connected to the casing and including at least one throat opening that communicates fluid to said rotor, said throat being formed by neighboring parts of said nozzle and adjusting means setting the distance between said parts to vary the opening size and regulate fluid feed to said rotor.

6. A turbine as claimed in claim 1, wherein said openings are in general alignment and said shaft passes through the openings, said passageway surrounding said shaft.

7. A turbine as claimed in claim 1 wherein the discs of each pack are separated by internal fences that direct fluid flow from the inlet means of said first pack to said passageway and then out of the outlet means of said second pack.

8. A multi-stage turbine comprising a casing and a rotor on a shaft journalled for rotation in said casing, said rotor comprising two adjacent disc packs mounted in tandem on said shaft, a first pack being a conical fluid inflow pack with an outer circumference having fluid inlet means, at least one inlet in said casing and an internal nozzle communicating fluid from said inlet to said inlet means, a second pack comprising spaced apart conical discs that face in a direction opposite to that of said input pack and having an outer circumference with fluid outlet means, said plates and discs of the two packs being X configured when viewed in section, respective web plates holding said packs, said plates being fastened to one another and rotatably supported by said casing, the discs of each pack having central openings that define a common fluid passageway within said rotor and said passageway being located adjacent said shaft to provide direct communication for the fluid from the interior of the inflow pack to the interior of the outflow pack before the fluid exits from said outflow means at the outer circumference of said second pack.

9. A multi-stage turbine comprising a casing and a rotor on a shaft journalled for rotation in said casing, said rotor comprising two adjacent disc packs mounted in tandem on said shaft, a first pack being a circular fluid inflow pack with an outer circumference having fluid inlet means, at least one inlet in said casing and an internal nozzle communicating fluid from said inlet to said inlet means, said nozzle comprising a segmented ring in a plenum that surrounds said rotor, said nozzle being connected to said casing and including at least one throat opening that communicates fluid to said rotor, said throat being formed by neighboring parts of said nozzle and adjusting means setting the distance between said parts to vary the opening size and regulate fluid feed to said rotor, said adjusting means being a displaceable member that interconnects said casing to said ring, said member comprising a rotor brake that can be urged through said ring against the periphery of said rotor, a second pack comprising spaced apart conical discs having an outer circumference with fluid outlet means, the discs of each pack having central openings that define a common fluid passageway within said rotor and said passageway being located adjacent said shaft to provide direct communication of the fluid from the interior of the inflow pack to the interior of the outflow pack before the fluid exits from said outflow means at the outer circumference of said second pack.

10. A multi-stage turbine comprising a casing and a rotor on a shaft journalled for rotation in said casing, said rotor comprising two adjacent disc packs mounted in tandem on said shaft, a first pack being a circular fluid inflow pack with an outer circumference having fluid inlet means, a plurality of inlets in said casing and an internal nozzle communicating fluid from said inlets to said inlet means, said plurality of inlets leading into a plenum between said nozzle and said casing, a throat opening in said nozzle being located a remote distance from each said inlet, a second pack comprising spaced apart conical discs having an outer circumference with fluid outlet means, the discs of each pack having central openings that define a common fluid passageway within said rotor and said shaft being located within said passageway, the discs of each pack being separated by internal fences that direct fluid flow from the inlet means of said first pack to said passageway and then out of the outlet means of said second pack, the normal fluid flow being into the outer circumference of the first pack and out of the outer circumference of the second pack.

11. A multi-stage turbine comprising a casing and a rotor on a shaft journalled for rotation in said casing, said rotor comprising two adjacent disc packs mounted in tandem on said shaft, a first pack being a circular fluid inflow pack with an outer circumference having fluid inlet means, at least one inlet in said casing and an internal nozzle communicating fluid from said inlet to said inlet means, said nozzle comprising a segmented ring in a plenum that surrounds said rotor, said nozzle being connected to said casing and including at least one throat opening that communicates fluid to said rotor, said throat being formed by neighboring parts of said nozzle and adjusting means setting the distance between said parts to vary the opening size and regulate fluid feed to said rotor, said nozzle being a ring assembly of neighboring segment parts that define a plurality of spaced apart throat openings equivalent to the aforesaid throat opening, said adjusting means comprising a displaceable member fitted in a respective segment part adjacent the corresponding said throat opening, said member being displaceable together with that segment part relative to the casing to increase or decrease the distance between the neighboring said segment parts, a second pack comprising spaced apart conical discs having an outer circumference with fluid outlet means, the discs of each pack having central openings that define a common fluid passageway within said rotor and said passageway being located adjacent said shaft to communicate fluid directly from the interior of the inflow pack to the interior of the outflow pack before the fluid exits from said outflow means at the outer circumference of said second pack.

* * * * *